United States Patent [19]

van Drimmelen et al.

[11] 4,382,419

[45] May 10, 1983

[54] FLOATING VESSEL WITH MOON WELL AND ICE GUARD THEREFOR

[75] Inventors: Nicolaas J. van Drimmelen; Rudolf H. Loevendie, both of Alblasserdam, Netherlands

[73] Assignee: IHC Holland N.V., Papendrecht, Netherlands

[21] Appl. No.: 206,462

[22] Filed: Nov. 13, 1980

[51] Int. Cl.[3] ..... B63B 35/02

[52] U.S. Cl. ..... 114/313; 114/40; 114/264

[58] Field of Search ..... 114/313, 40, 138, 264; 175/7; 405/211

[56] References Cited

U.S. PATENT DOCUMENTS

| | | | |
|---|---|---|---|
| 2,488,542 | 11/1949 | Houghtaling | 114/264 |
| 2,808,229 | 10/1957 | Bauer et al. | 175/7 |
| 2,808,230 | 10/1957 | McNeill et al. | 175/7 |
| 2,909,359 | 10/1959 | Bauer et al. | 175/7 |
| 2,929,610 | 3/1960 | Stratton | 175/7 |
| 3,299,846 | 1/1967 | Jarian | 114/264 |
| 3,414,067 | 12/1968 | Bauer et al. | 175/7 |
| 3,426,858 | 2/1969 | Bauer et al. | 175/7 |
| 3,672,447 | 6/1972 | Kofahl | 175/7 |
| 3,918,380 | 11/1975 | Graham et al. | 114/264 |
| 4,073,144 | 2/1978 | Lea | 114/40 |
| 4,145,770 | 3/1979 | Zaris | 114/264 |

FOREIGN PATENT DOCUMENTS

| | | | |
|---|---|---|---|
| 5077435 | 8/1977 | Japan | 114/264 |

*Primary Examiner*—Trygve M. Blix
*Assistant Examiner*—C. T. Bartz
*Attorney, Agent, or Firm*—Young & Thompson

[57] ABSTRACT

Large vessel having an opening in the bottom of the hull said hull portion being provided with an upwardly and downwardly movable grid structure shielding the opening against ice flakes which pass along the bottom of the hull.

3 Claims, 1 Drawing Figure

FLOATING VESSEL WITH MOON WELL AND ICE GUARD THEREFOR

Figure 1:
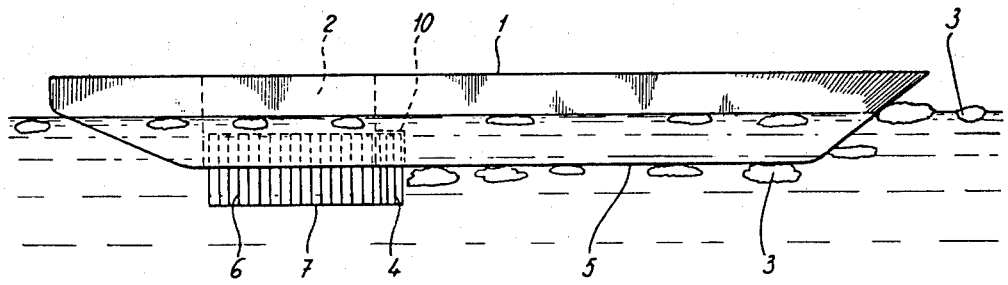

The present invention relates to large floating devices such as large vessels having an opening in the bottom of the hull through which operations can take place such as the hull recess of fishery vessels or the so called moon pool of a drilling vessel. Devices of this type, in particular vessels, are well known. Drilling vessels as a rule are provided with a moon pool located below the drilling rig and through which drilling operations are performed. For dredging purposes large vessels have been designed having a rearwardly extending opening through which may extend a suction tube or a cutter ladder. Said opening also at its rear end may be closed.

When vessels of this type have to operate under arctic conditions it happens that ice flakes shift below the bottom of the hull and enter the opening where they form a serious obstruction for performing the work to be done. This even happens with special ice breaking design of the hull adapted to move the ice flakes laterally away.

The invention aims at a simple solution for this problem and according to the invention this is solved in that the opening has been provided with an upwardly and downwardly movable wall or fence structure which in its downward position extends below the bottom of the hull and along at least the front side and the side edges of the opening. Ice flakes which move along the bottom of the vessel now are simply prevented from entering the opening and are pushed away sidewards.

Preferably this structure has the form of a grid and has a pointed front end.

The invention now will be further elucidated with reference to the drawing in which:

FIG. 1 is a side view of a vessel according to the invention and

Figure 2:
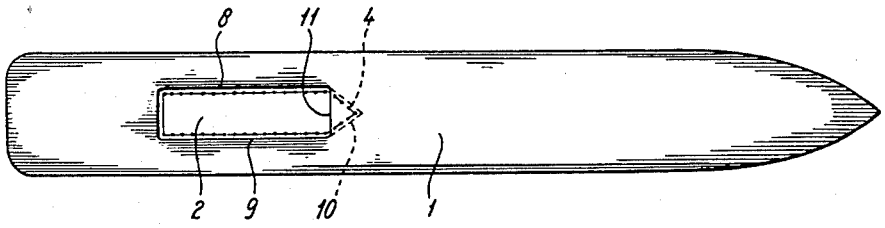

FIG. 2 a top view thereof.

The vessel 1 which is shown only schematically has a large opening in its rear portion indicated at 2 which opening extends from deck to bottom. This opening e.g. can be used for lowering a suction tube or other dredging devices.

As shown in FIG. 1 ice flakes 3 may slide along the bottom of the hull and might enter the opening.

To prevent this the hull has been provided with a grid structure 4 which can be moved upwardly to a position in which it does not extend below the bottom 5 of the hull and downwardly to the position shown in FIG. 1. As shown in the drawing the grid structure is formed by a great number of vertical rods 6 interconnected by horizontal bars 7 and this grid structure extends along the inner side edges 8 and 9 of the opening 2 and along the tapered front edge 10 of the opening of the bottom. At the deck the opening may have a straight front edge 11.

The movements of the grid structure can be performed by any suitable means such as hydraulic cylinders, hoisting means and the like. The gride structure simply can be guided within the walls of the opening or can be guided upon separate means secured to the hull.

Instead of a grid structure any type of rigid wall or fence structure can be used having openings through which the water can pass but ice particles or the like cannot.

We claim:

1. In a floating vessel having a hull and an opening through the bottom of the hull, the opening through the bottom of the hull being bounded by upright side walls of the hull; the improvement comprising an openwork fence structure for the purpose of preventing ice from entering said opening, said fence structure disposed in said opening and guided by the side walls of the opening for vertical movement between a raised position in which the fence structure does not extend below the bottom of the hull and a lowered position in which the fence structure extends both above and below the bottom of the hull, said fence structure being comprised by vertical rods, the fence structure having a plurality of sides as seen from above, there being a plurality of said vertical rods intermediate the ends of each side of the fence structure, said vertical rods forming a pair of vertical side walls that extend lengthwise of the vessel, the space between these side walls being open and unimpeded as seen from above, so as to allow further structure to be independently raised and lowered through the unimpeded space.

2. Structure as claimed in claim 1, the fence structure being in the form of a grid.

3. Structure as claimed in claim 1, the opening in the bottom of the hull having a tapered forward end and the fence structure having a tapered forward end complementary to the taper of the forward end of the hull opening.

* * * * *